United States Patent [19]

Hill

[11] 4,101,807

[45] Jul. 18, 1978

[54] METHOD AND APPARATUS FOR CONTROLLING THE TEMPERATURE OF LOW PRESSURE METAL OR METAL HALIDE LAMPS

[75] Inventor: Howard M. Hill, Glendale, Calif.

[73] Assignee: Xerox Corporation, Stamford, Conn.

[21] Appl. No.: 669,079

[22] Filed: Mar. 22, 1976

[51] Int. Cl.[2] ..... H05B 41/36

[52] U.S. Cl. ..... 315/116; 315/117; 355/69

[58] Field of Search ..... 315/112, 115, 116, 117, 315/108, 151; 355/8, 35, 69

[56] References Cited

U.S. PATENT DOCUMENTS

| | | | |
|---|---|---|---|
| 2,113,314 | 4/1938 | Brueckmann | 315/116 X |
| 2,491,881 | 12/1949 | Van Liempt | 315/116 X |
| 2,581,959 | 1/1952 | Koehler | 315/116 |
| 3,296,488 | 1/1967 | Taylor | 315/116 |
| 3,432,232 | 3/1969 | Tompkins | 315/108 X |
| 3,914,649 | 10/1975 | Hug | 355/69 X |

*Primary Examiner*—Eugene R. LaRoche

*Attorney, Agent, or Firm*—Sheldon F. Raizes; Irving Keschner; Terry J. Anderson

[57] ABSTRACT

A low pressure metal or metal halide vapor lamp for photocopying applications. The low pressure sodium vapor lamp is operated in a continuous mode and provides illumination of increased brightness and of a color (yellow) which is optimum for providing a copy which is an accurate representation of the original. An auxiliary heater is formed on the lamp to both decrease the warm-up time of the lamp and to control lamp temperature for optimum light output, an electrical control circuit being coupled to the heater to control the current therethrough.

11 Claims, 5 Drawing Figures

METHOD AND APPARATUS FOR CONTROLLING THE TEMPERATURE OF LOW PRESSURE METAL OR METAL HALIDE LAMPS

BACKGROUND OF THE INVENTION

In the xerographic process as described in U.S. Pat. No. 2,297,691, a base plate of relatively low electrical resistance such as metal, etc., having a photoconductive insulating surface coated thereon is electrostatically charged in the dark. The charged coating is then exposed to a light image. The charges leak off rapidly in the base plate in proportion to the intensity of light to which any given area is exposed, the charge being substantially retained in non-exposed areas. After exposure, the coating is contacted with electrostatic materials which adhere to the remaining charges to form a powder image corresponding to the latent electrostatic image remaining after exposure. The powder image then can be transferred to a sheet of transfer material resulting in a positive or negative print, as the case may be. Since dissipation of the surface electrostatic charge is proportional to the intensity of the impinging radiation, light sources of uniform and sufficient intensity must be provided so that the photoconductive insulator can be properly exposed.

Low pressure metal or metal halide lamps are a near optimum illumination source for photocopiers producing black and white output copies from black and white and multi-colored originals.

With respect to line copy, the optimum goal of any black and white photocopying apparatus is to make the image areas on the copy as black as possible. In other words, one would like a minimum of energy reflected from the image areas of the original while reflecting a maximum from the background region. Obviously, it is impossible to copy all colored backgrounds as white while concurrently copying all colored images as black.

From prior experience, it appears that most colors that are utilized as images on an original tend to be located at the extremes of the visible spectrum, i.e., blues and reds, whereas yellow, for example, is seldom utilized for images. Colored backgrounds are pastel (desaturated) and can usually be considered as tinted white paper which may be explained in part on well known principles of physiological optics (photoptic vision).

It then follows that the optimum light source for photocopying apparatus producing black and white output copies from black and white and multi-colored originals produces yellow light whereby black and reds will copy as black, while concurrently most common colored papers have considerable reflectance in yellow (it should be noted that the use of the yellow exposure lamps obviously necessitates a yellow sensitive photoreceptor). However, the typical prior art photocopying apparatus utilizes aperture fluorescent lamps which generate colored light.

Low pressure sodium lamps represent a commercially available yellow light source. Present commercial sodium lamps, such as those manufactured by N. V. Phillips, have several disadvantages for photocopying applications associated therewith.

The principal problem is that a long warm-up period is required before the lamp may be operated at its optimum light output or efficiency, i.e., at an operating temperature of approximately 260° C which in turn corresponds to a vapor pressure of approximately 0.005

Torr. For example, whereas unassisted fluorescent lamps require only a matter of seconds to reach peak radiance, unassisted sodium lamps require several minutes to heat the lamp and achieve the optimum vapor pressure for radiation output. The prior art has sought to reduce long warm-up times in sodium lamps by maintaining the lamp continuously energized. However, additional problems arise if the sodium lamp is on continuously. For example, the photoreceptor may fatique when it is continuously flooded with light produced by said sodium lamp, the heat generated by the sodium lamp may harm the photoreceptor, and continuous operation of the lamp may add to the cost of a customer's electrical bill. Further, most commercially available low pressure sodium lamps are in a U-tube configuration which causes a fit problem in most photocopying apparatus because of its large diameter, the U-shaped lamp also emitting light in all directions which is inefficient and unacceptable for photocopying use.

U.S. Pat. No. 3,914,649, issued on Oct. 21, 1975, discloses a low pressure sodium vapor lamp for use in photocopying apparatus operated in a pulsed mode. Although advantages are attained in using such a lamp in a pulsed mode, it is desirable in many applications that a low pressure sodium vapor lamp of high efficiency and short warm-up periods be provided without the additional components required for pulsed operation. Copending application of James F. Shaw et al, Ser. No. 668,875 filed concurrently herewith discloses a low pressure sodium vapor lamp of this type.

Another problem in using a low pressure sodium lamp is the control of the sodium vapor pressure in the discharge. If the pressure is too high, resonance trapping occurs and the lamp efficacy drops. If the sodium pressure is too low, the efficacy also drops through for different reasons.

Typically, the sodium pressure required is about $5 \times 10^{-3}$ Torr, and for a precision load, very tiny amounts of sodium would be required. However, adequate tube lifetimes with precision loaded tubes have not been provided by tube manufacturers because of sodium clean-up as the tube ages.

The problem can be solved by using a large excess of sodium and regulating the sodium pressure by changing the lamp temperature. This requires that the lamp must be held continuously at about 260° C for optimum light output since the lamp temperature cannot change more than a few degrees before the output falls off. This necessitates a precise and dependable temperature control system capable of holding a substantially constant lamp temperature regardless of ambient temperature variations.

SUMMARY OF THE PRESENT INVENTION

The present invention provides a control system for controlling the operating temperature of a low pressure metal or metal halide vapor lamp for use in photocopying apparatus. In the preferred embodiment, the active material comprises sodium. The low pressure sodium vapor lamp provides illumination of increased brightness and of a color (yellow) which is optimum for providing a copy which is an accurate representation of the original. In order to decrease the warm-up time of the lamp operating temperatures relatively quickly, and control the lamp operating temperature an auxiliary heater is formed on the lamp discharge tube. This heater is made of a material with a positive temperature coefficient and which is tightly coupled thermally to the discharge tube.

The heater resistance gives the lamp temperature and by changing the heater power the lamp temperature can be changed. This allows both control and adjustment functions to be performed by the same element which minimizes the number of leads that must go to the lamp.

The temperature control circuit measures the ratio of heater voltage to heater current, the ratio being compared against a reference to control the heater current thereby maintaining the lamp at the optimum temperature.

It is an object of the present invention to provide method and apparatus for controlling the temperature of a low pressure metal or metal halide lamp.

It is a further object of the present invention to provide method and apparatus for controlling the temperature of a low pressure sodium vapor lamp utilized as an illumination source in photocopying apparatus.

It is still a further object of the present invention to provide method and apparatus for controlling the sodium vapor pressure in a low pressure sodium vapor lamp discharge by automatically controlling the lamp temperature, the sodium vapor lamp providing a spectral output which is particularly useful in photocopying applications.

It is a further object of the present invention to provide method and apparatus for controlling the temperature of a low pressure sodium vapor lamp by providing heating means associated with the sodium discharge tube, the heating means operable to provide both an indication of lamp temperature and means for heating the lamp, the heating means being coupled to an electrical control circuit for maintaining the lamp temperature at a value selected to optimize the spectral output of the lamp.

BRIEF DESCRIPTION OF THE DRAWINGS

For a better understanding of the present invention, as well as other objects and further features thereof, reference is made to the following description which is to be read in conjunction with the accompanying drawings wherein.

DESCRIPTION OF THE PREFERRED EMBODIMENT

Figure 1:
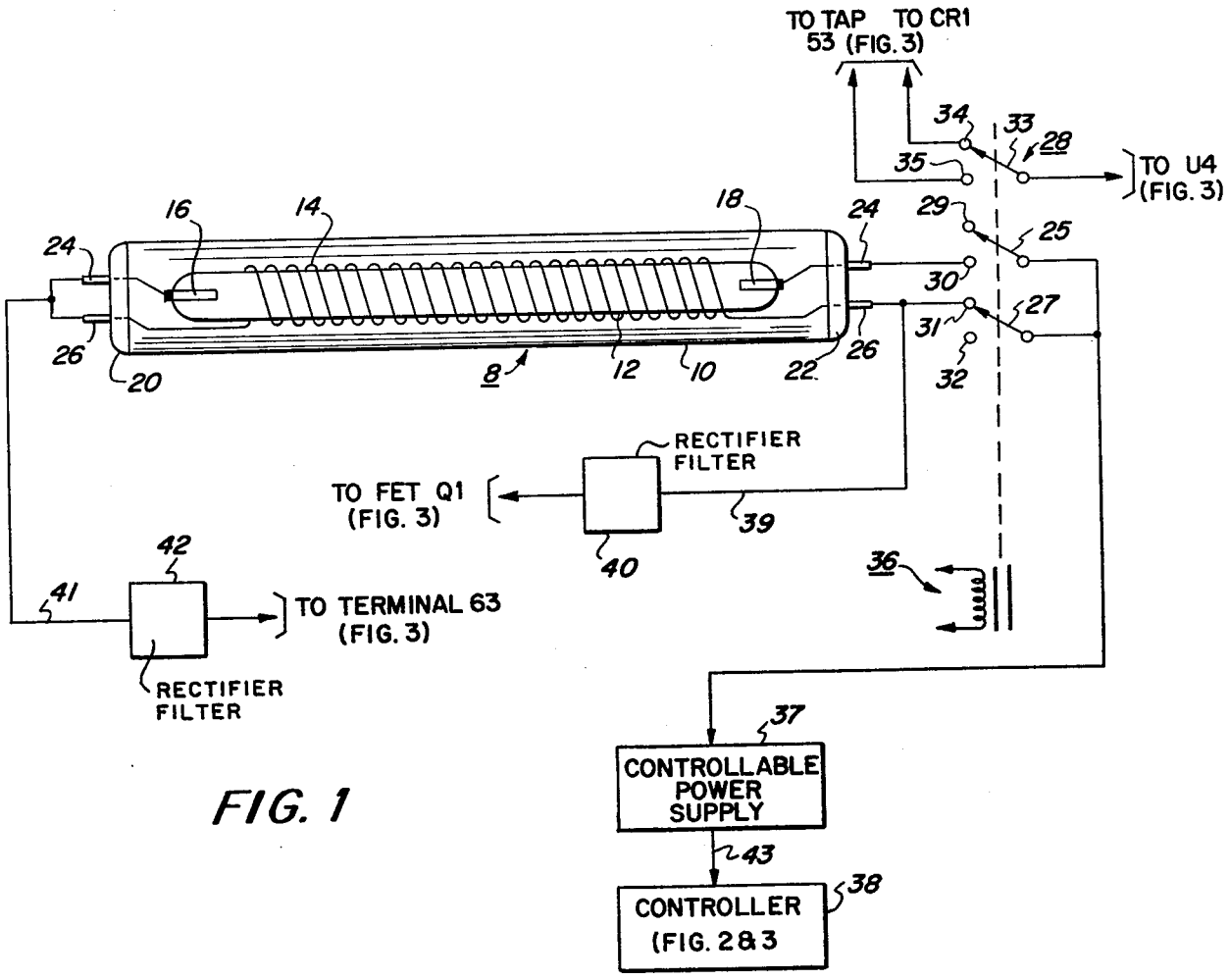
FIG. 1 shows a low pressure sodium vapor lamp in accordance with the teachings of the present invention.

FIG. 1 is a partial cross-sectional view of the low pressure sodium vapor lamp 8 of the present invention. The lamp 8 comprises an outer envelope 10, a linear, inner envelope, or discharge tube 12, heater wire 14, electrodes, or filaments 16 and 18 and tube sealing end caps 20 and 22, each end cap incorporating end pins 24 and 26.

As shown in the figure, pins 24 and 26 in end cap 22 are coupled to the contact arms 25 and 27, respectively, of double pole, single throw switch 28. Contacts 29 and 30 are associated with contact arm 25 and contacts 31 and 32 are associated with contact arm 27. Switch 28 further includes contact arm 33 with associated contacts 34 and 35. Relay coil 36, which controls the operation of switch 28, is connected to contacts in the photocopying apparatus which utilizes lamp 8, the coil being energized when the lamp is being energized (i.e. when a photocopy is to be provided). In the standby mode, the contact arms 25, 27 and 33 are positioned at contacts 29, 31 and 34 respectively, and in the operating mode (coil 36 energized), contact arms 25, 27 and 33 are simultaneously positioned to contacts 30, 32 and 35, respectively to provide lamp power from power supply 37.

In the standby mode, power supply 37 is arranged to control the current in heater wire 14 in a manner whereby the lamp vapor temperature is maintained at a value which is optimum for lamp efficiency and reduced lamp warm-up In in particular, power supply 37 provides a source of ac current to heater wire 14, the magnitude of the current being dependent, the voltage generated by a controller 38 (described in detail hereinafter with reference to FIGS. 2 and 3) and applied to power supply 37 via lead 43. Controllable power supplies are well known in the prior art and will therefor not be described herein.

An analog voltage (VsH) representing the heater wire voltage is generated by tapping the lead to pin 26 in end cap 22 via lead 39 to rectifier/filter 40 which converts the ac voltage on lead 39 to a dc voltage.

Pins 24 and 26 in end cap 20 are tied together, current flowing therefrom being coupled to rectifier/filter 42 via lead 41, rectifier/filter 42 converting the ac current carried by lead 41 to a dc analog voltage (IFB) representing the value of the heater wire current. The outputs of rectifier/filter 40 and 42 are coupled to FET Q1 and terminal 63, respectively, shown in FIG. 3, the operation of which is described hereinafter.

As set forth hereinabove, in order to decrease lamp warm-up time and achieve operating temperature rapidly, auxiliary resistance heater 14 is used, the resistance heater also being used to maintain the inner tube at its normal operating temperature (approximately 260° C for sodium). However, the heater can be used to maintain the temperature at any desired value. The preferred embodiment of the resistance heater consists of a spiral wrapped wire around the linear sodium tube 12 with the spacing of the wraps being dependent on the length of wire required. For efficient operation, there are two requirements for the heater wire. First, it should be oxidation-resistant and secondly, should show an appreciable variation in resistivity with temperature. This allows controller 38 which controls power supply 37 to sense temperature changes in the lamp being heated for control purposes as set forth hereinbelow. In the preferred embodiment, 0.010 inch alumel wire is utilized. This nickel-iron alloy resists oxygen attack and changes resistance considerably with temperature. The preferred construction is wire or strip, but is not limited to the stated shape as long as its functional characteristic is fulfilled. Other techniques may be utilized to heat the inner envelope 12 such as applying a transparent conductive coating to the lamp envelope or by utilizing a heating resistance within the inner lamp envelope, as shown in U.S. Pat. No. 2,755,400. The auxiliary heater 14 consumes less power than an operating lamp and since there is no visible radiation from the tube 12 during preheat and while on standby there is no photoreceptor fatigue which can occur if a lamp is running continuously (i.e. radiation is emitted continuously).

The present preferred standby or warm-up cycle (with contact arms 25, 27 and 33 positioned at contacts 29, 31 and 34, respectively) uses a high current (i.e. 3.0 amps) initially for start-up and as the heater resistance 14 increases to its normal operating point, power supply 37 switches to a lower current (approximately 2.1 amps) to hold this resistance constant. When contact arms 25, 27 and 33 are positioned at contacts 30, 32 and 35, respectively, the arc is ignited and heater power is simultaneously turned off. When the arc is extinguished, the lamp is in the standby mode and heater wire power is applied as described hereinabove. The system for controlling the heater wire is set forth hereinbelow with reference to FIGS. 2 and 3.

A preferred sodium vapor lamp aperture is described in copending Application Ser. No. 668,875 filed Mar. 22, 1976, assigned to the assignee of the present invention. The teachings of the copending application which are necessary for the understanding of the present invention are incorporated herein by reference.

FIG. 1 illustrates a design which may be utilized in photocopying apparatus. The linear arc tube 12 is placed within a 1.5 inch diameter transparent tube 10 which is coated with a diffuse coating. Commercially available two pin end caps 20 and 22 typically used on fluorescent lamps, is peferably used for electrical connections. In particular, pin 24 carries lamp power and pin 26 carries auxiliary heater power.

Typically the filaments 16 and 18 are spaced from each other within an insulating tube, or container 12 which is filled with an alkali metal and gas mixture. The choice of the fill gas, its fill pressure, and the elctrode filament separation distance depend on desired radiation characteristics, and also its electrical characteristics in relationship with the power supply. The insulating wall container 12 may be made of quartz, glass, quartz/glass combination (any of which can be coated or manufactured for resistance to attack by alkali metals), or ceramic material. The fill gas may be xenon, krypton, neon, or argon or any combination of inert gases, whereas the alkali metal may include the whole series and combinations thereof. The preferred combination of fill gas and alkali metal is sodium alkali metal at an operating pressure of 0.005 Torr with a gas mixture fill, at a pressure of about 5 Torr of neon and 1 percent argon, the argon pressure being about 0.05 Torr.

In the operating mode, coil 36 is energized and the current from source 37, applied to the filament 18 via pin 24, contact arm 25 and contact 30, is sufficient to effect a discharge through the gaseous medium within the envelope 12 between the filaments 16 and 18. This initial voltage required to operate the lamp is referred to as the break-down voltage and is usually greater than later lamp operating voltages because of increased ionization and electrical conductivity of the gaseous medium within envelope 10 after the lamp has been operated for a time.

Lamp 8, in accordance with the teachings of the present invention, is a metal or metal halide vapor lamp, and in the preferred embodiment, comprises a low pressure sodium vapor lamp. When the gas is ionized, as described hereinabove, an actinic light is generated. Since low pressure sodium is utilized, the spectral output is predominantly in the 5900A range and corresponds to yellow light.

The heating current supplied by power supply 37 heats winding 14 to maintain the inner envelope 12 at an elevated temperature (i.e., approximately 260° C) which causes the vapor pressure of the sodium to be correspondingly optimized for optimum sodium line output, i.e., spectral output is primarily centered about 5900A and to decrease the warm-up time of the lamp whereby the lamp operating temperature is achieved relatively quickly.

In addition to the sodium vapor lamp described hereinabove, other materials, such as thalium, thalium iodide and potassium, may be utilized as the gaseous medium albeit sodium is preferred for the reasons set forth hereinabove.

Figure 2:
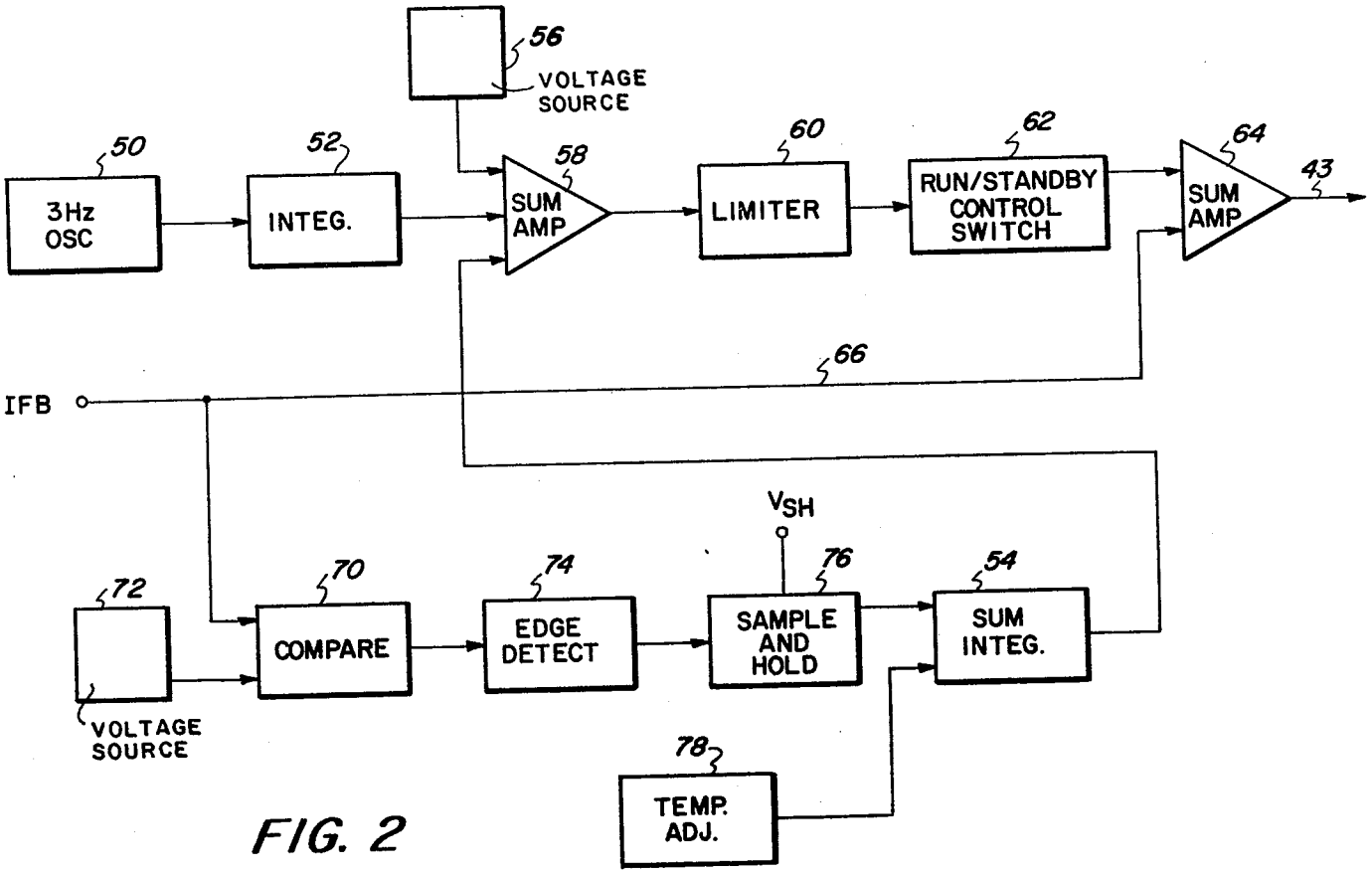
FIG. 2 is a block diagram of the novel control circuitry of the present invention.

Referring now to FIG. 2, a block diagram of the circuitry utilized to control power supply 37 and thereby control heater wire 14 is shown. A 3-Hz oscillator 50 generates a square wave which is applied to integrator 52 the output thereof being a triangular wave.

The 3-Hz output of oscillator 50 is approximately the geometric mean of the thermal response of lamp 10 and the output response of power supply 37.

The triangular wave, the output of sum integrator 54 and an offset voltage from voltage source 56 all are applied to summing amplifier 58.

The triangular wave functions to modulate the heater current about 2.1 amps peak to peak. The output of sum integrator 54 is the integrated temperature error voltage which provides power correction. The offset voltage from source 56 sets the average value of the heater current which allows the sum integrator output to be near zero when the lamp is stable in normal environments so greater dynamic range is obtained from the control system.

The signal from sum amplifier 58 is applied to limiter 60 is provided to clip the signal peaks to a value that corresponds to a peak heater current that power supply 37 can handle.

In the standby mode, switch 62 applies the limited signal to a difference amplifier 64. The limited signal is an analog of what the heater resistance should be. The signal IFB, generated by rectifier/filter 42 (FIG. 1) is applied to difference amplifier 64 via lead 66 and is an analog of what the heater current actually is. The difference is the power supply error and it is applied as a correcting signal to the power supply 37 via lead 43.

In the run, or operating mode, switch 62 (actually a portion of switch 28) applies a constant voltage to difference amplifier 54 to maintain a predetermined current applied to heater 14 which maintains the lamp at approximately 260° C, switch 28 simultaneously shifting the output of power supply 37 from the heater wire 14 to the discharge tube 12 as described hereinabove allowing the lamp to operate.

Signal IFB is also applied to comparator 70 which comprises a high gain operational amplifier. A voltage from source 72 corresponds to the fixed sampling point and is also applied to comparator 70. The output of comparator 70 is a rectangular wave with transitions occurring when IFB is equal to the voltage from source 72. The output from source 72 is adjusted so that transitions occur when the heater current crosses 2 amps. This means that heater resistance is equal to the heater voltage divided by 2 when the output from comparator 70 changes state.

Edge detector 74 is provided to generate a 1-msec pulse on every transition of the output of comparator 70. The output from edge detector 74 gates a sample and hold circuit 76 and allows circuit 76 to charge up to VSH which is an analog of the heater voltage when the heater current passes a fixed value. This is directly proportional to the heater resistance, and hence, the lamp temperature. The analog voltage VsH is provided by rectifier/filter 40 as described hereinabove with reference to FIG. 1.

The output of voltage source 78, the lamp temperature adjust, applies a negative voltage to sum integrator 54. When the lamp temperature is equal to the control value from source 78, the output from sum integrator 54 is constant. When the signals are unequal, the output moves up or down adjusting the heater power as previously described.

This automatic adjustment allows the heater to receive enough power to keep the lamp at approximately 260° C.

When power supply 37 is first energized, full power is applied and the lamp is rapidly and smoothly brought up to temperature. Then, as the running temperature is reached, power is reduced until the lamp is stable at approximately 260° C.

Figure 3:
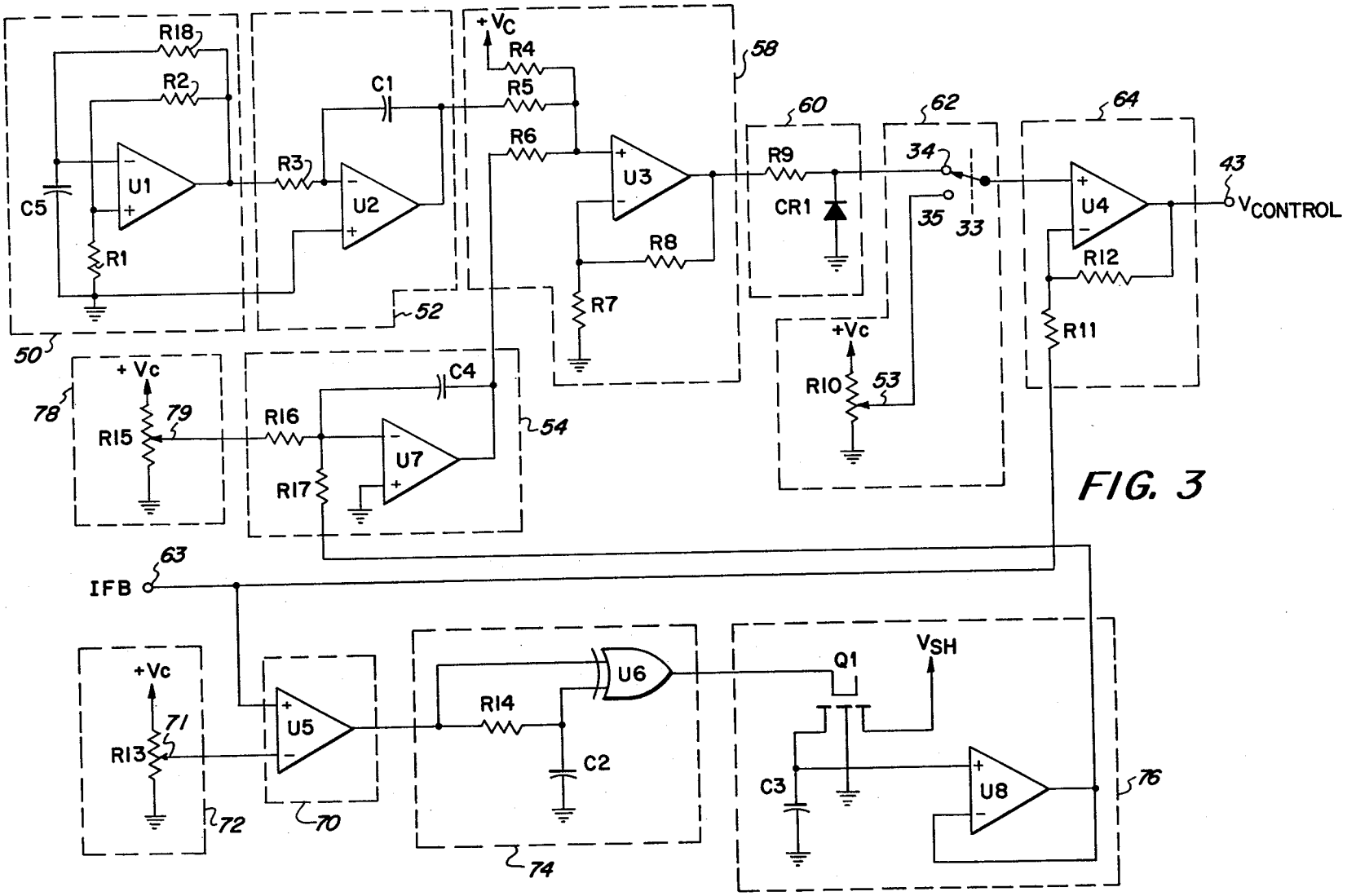
FIG. 3 is a simplified schematic circuit of the block diagram of FIG. 2.
Figure 4:
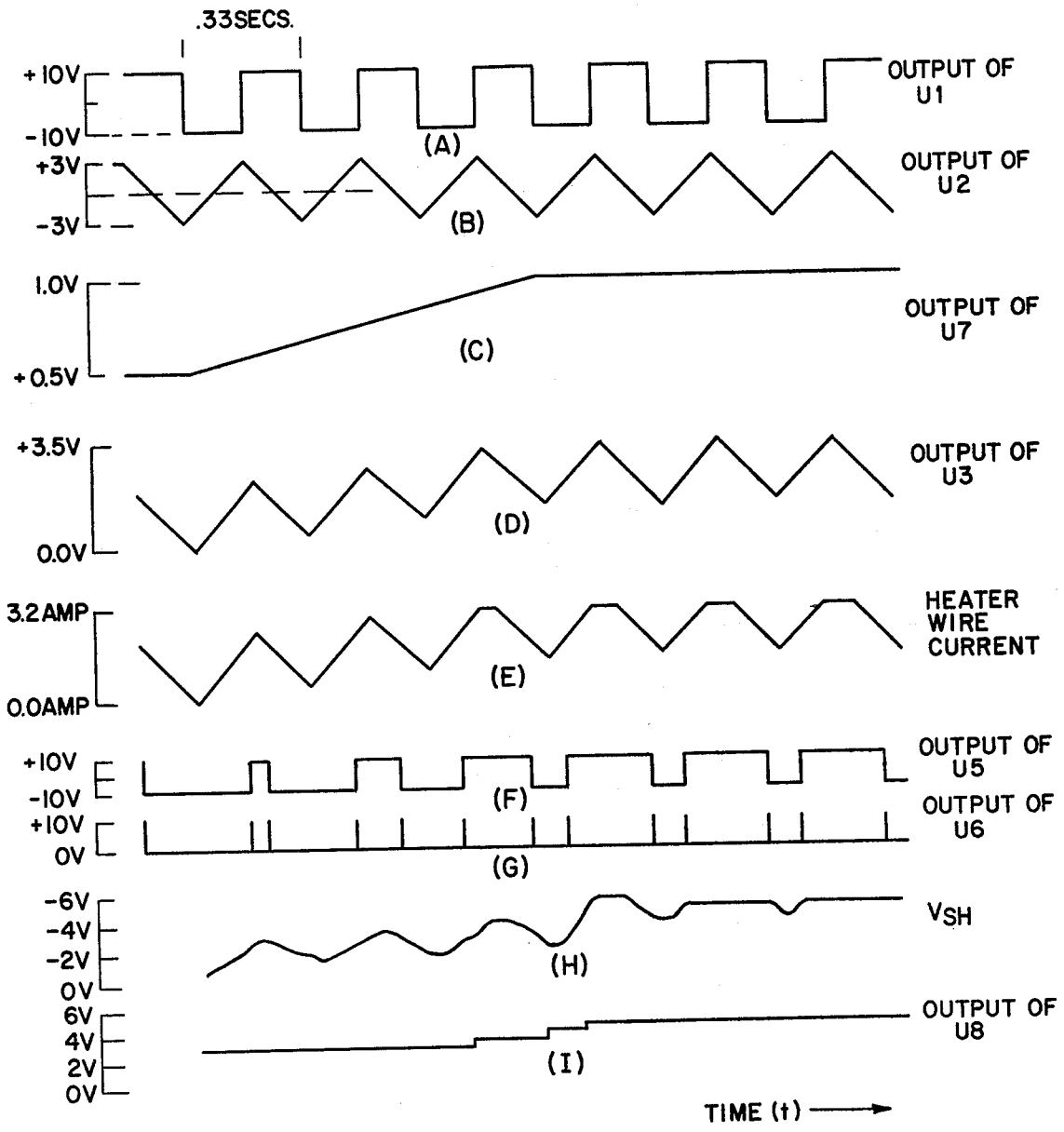
FIG. 4 shows representative waveforms produced by the circuit of FIG. 3.

FIG. 3 is a schematic diagram of the block diagram shown in FIG. 2. The corresponding waveforms at various points of the schematic diagram are shown in FIG. 4, the waveforms being provided to show relative voltage/current values. The 3-Hz oscillator 50 comprises an operational amplifier U1, input resistor R1, feedback resistors R2 and R18, and capacitor C5, the element values being selected to provide the 3-Hz output. The oscillator output is coupled to integrator 52 comprising capacitor C1, resistor R3 and operational amplifier U2, the integrator output being a triangular wave. Summing amplifier 58 comprises resistors R4, R5, R6, R7, R8 and operational amplifier U3. The output of summing amplifier 58 is applied to limiter 60 which comprises resistance R9 and Zener diode CR1.

The limiter clips the signal peaks to a value that corresponds to a peak heater current that the power supply 37 can handle. Switch 62 comprises contact arm 33 and contacts 34 and 35 of switch 28 (FIG. 1) and a potentiometer comprising voltage source Vc, resistance R10 and adjustable tap 53.

In the standby position, with contact arm 33 positioned at contact 34 as shown, the limited signal, an analog representation of what the heater temperature should be, is applied to difference amplifier 64 comprising resistors R11 and R12 and operational amplifier U4. In the standby condition, the temperature of the lamp 8 is brought rapidly to the desired value.

In the operating, or run position, contact arm 33 is positioned at contact 35 and applies a voltage from R10 to the difference amplifier 64 which still acts to monitor and control the lamp temperature. Switch 28, as shown in FIG. 1, has simultaneously shifted the power supply output from the heater wire 14 to the discharge tube 10 thereby allowing the lamp to run as described hereinabove.

Comparator 70 comprises U5, a high gain operational amplifier running open loop. A voltage from source 72, which comprises a potentiometer comprising resistor R13, voltage Vc and tap 71, corresponds to the fixed sampling point which is also applied to U5. U5 has a very high gain so that the output thereof is a rectangular wave with transitions occurring when IFB is equal to the voltage on tap 71. Tap 71 is set so transitions occur when the heater current crosses 2 amperes. This means the heater resistance is equal to the heater voltage divided by 2 when the output from U5 changes states.

R14 and C2 make up a delay network that is connected to U6, an exclusive or gate. The gate output is true only when both inputs are in different states. This can only occur just after U5 changes states and lasts until C3 charges or discharges enough to cross the threshold of U6, a matter of about 1 msec. The gate and delay network act as an edge detector 74 which generates a 1-msec pulse on every transition of the output of U5.

The pulse from U6 gates a sample and hold circuit 76 comprising field effect transistor (FET) Q1, capacitor C3 and operational amplifier U8. The output from U6 turns on Q1 and allows C3 to charge up to VSH which is an analog representation of the heater voltage. U8 has a very high impedance and its output is equal to the voltage on C3. During the 1-msec pulse, the resistance of Q1 is about $10^3$ ohms. The remainder of the time the resistance of Q1 is about $10^{12}$ to $10^{14}$ ohms. This allows C3 to charge to VSH during the 1-msec pulse and discharge very little during the off time. The output of U8 is then an analog representation of the heater voltage when the heater current passes a fixed value. This is directly proportional to the heater resistance, and hence, the lamp temperature.

The output from U8 is applied to the sum integrator 54. The lamp temperature adjust, 78, comprising voltage Vc, resistor R15 and adjustable tap 79, applies a negative voltage to resistor R16 of sum integrator 44, sum integrator 44 comprising resistors R16 and R17, capacitor C4 and operational amplifier U7. When the lamp temperature is equal to the control value from R15, the output of U7 is constant. When the signals are unequal, the output of U7 moves up or down adjusting the heater power as previously described, the automatic adjustment allowing the heater to receive just enough power to keep the lamp at approximately 260° C.

When power supply 37 is first energized, full power is applied to heater wire 14 via pin 26, contact arm 27 and contact 31 and the lamp is rapidly and smoothly brought up to temperature by the circuit shown in FIG. 3, the circuit being fully operative since contact arm 33 is positioned at contact 34. Then, as the running temperature is reached, power is reduced until the lamp is stable at 260° C, switch 28 switching to the run condition and causing contact arms 25, 27 and 33 to be appropriately positioned (at contacts 30, 32 and 35, respectively).

Figure 5:
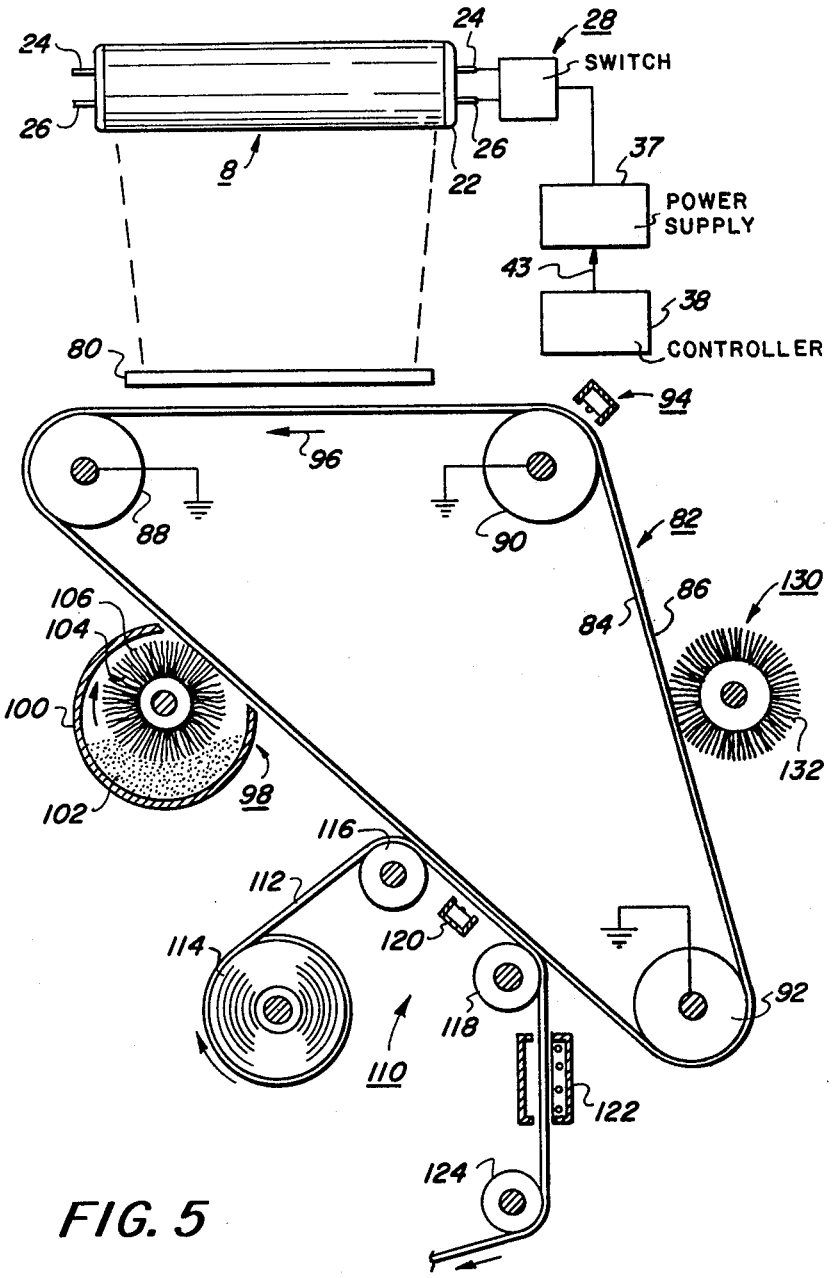
FIG. 5 illustrates an electrostatic photocopying apparatus in which the present invention may be utilized.

FIG. 5 schematically illustrates apparatus for electrostatically photocopying documents, or originals, using the xerographic process and the subject matter of the present invention. The sodium vapor lamp apparatus described in FIG. 1 is positioned above original 80 from which copies are to be made. In the embodiment illustrated, endless belt 82 having a conductive base 84 and a coating 86 of photoconductive material, which is selected to be rendered conductive by the illumination generated by lamp 8 is arranged to run on spaced drums 88, 90, and 92 underneath document 80. Although not shown in the figure, drums 88, 90 and 92 are driven in tandem by an appropriate drive motor.

In operation, the photoconductive belt 82 which essentially comprises a layer made of selenium on an alloy thereof overlying a conductive substrate is initially charged at charging station 94. The charging station comprises a generally well known corona charging device as shown in the prior xerographic art, for example. The belt 82, shown in an endless belt configuration, is driven in the direction of arrow 96. When the lamp 8 is energized in the manner described hereinabove (i.e., when a copy is to be made), the illumination generated thereby (the sodium spectral line in the preferred embodiment) illuminates document 80. It should be noted that the apparatus of FIG. 5 assumes that the original 80 is a transparency since the illumination will pass therethrough to expose photoconductive layer 86. obviously, illumination lamp 8 can be positioned below original 80 if the original is opaque, the generated light being reflected therefrom. In any event, the portions of the document 80 corresponding to image areas or dark areas are absorbed and the background or transparent areas illumination are passed through to discharge the appropriate portions of the belt 86. The belt is advanced to a development station 98 whereat a housing 100 contains a charge of electroscopic toner particles 102 and a roll 104 having a brush 106 on its surface. As roll 104 rotates, the brush 106 passes through the toner particles and then across the surface of belt 82, distributing the toner particles over the surface of the belt. The toner particles adhere to the belt in areas containing a residual charge, but not in the uncharged areas, resulting in development to visual form of the latent electrostatic image corresponding to document 80. Alternate development techniques may be utilized, such as powder cloud development as described, for example, in U.S. Pat. No. 2,701,764.

At station 110, this image is transferred to image receiving web 112. Web 112 is drawn from supply roll 114 and is guided in contact with belt 82 for a short distance by guide rolls 116 and 118. Transfer of the toner particles constituting the development image may be aided by an appropriate electrical field or by charging of the web 112 by corona charging electrode 120, as is well understood in the art. After the image is transferred to the web 112, the web may be passed through a heater 122 to fuse the toner particles to the web, and the web is guided by reel 124 to a delivery station.

Since the photoconductive layer 86 is to be reused for a subsequent imaging cycle, after the image transfer operation residual toner particles are removed from the surface of belt 82 by brush 132 at station 130. The photoconductive layer 86 may then be exposed to an illumination source, to erase any residual electrostatic image. Before returning to the optical exposure station, the surface of the photoconductor is exposed to a general corona discharge at station 94, the provide a uniform electrostatic charge over the photoconductive layer 86 and thereby enable electrostatic optical recording of an image of the document 80.

If a multiple number of copies of original 80 are to be made, the same operation is repeated. If a copy of a different original is desired, the original 80 is replaced with the different original.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. Apparatus for forming a latent electrostatic charge pattern on a photoconductive insulating medium, said latent electrostatic charge pattern corresponding to the radiation pattern projected from an information bearing member comprising:

a charged photoconductive insulating member, a low pressure metal vapor source for generating radiation of a predetermined spectral line, said information bearing member being interposed in the optical path between said metal vapor source and said charged photoconductive insulating member, means for energizing said low pressure vapor source whereby radiation is emitted therefrom, said radiation exposing said information bearing member to selectively dissipate the charge on the surface of said photoconductive insulating member in accordance with the intensity of the radiation projected from said information bearing medium to form said latent electrostatic charge pattern, means for heating said metal vapor source to a predetermined temperature, and means coupled to said heating means for maintaining said temperature at said predetermined value.

2. The apparatus as defined in claim 1 wherein said low pressure vapor source comprises a sodium vapor lamp.

3. The apparatus as defined in claim 2 wherein said low pressure sodium vapor lamp comprises:

a discharge tube having spaced-apart electrodes and low pressure sodium vapor therein, means for coupling a signal to said electrodes of an amplitude sufficient to breakdown said sodium vapor and initiate a discharge between said electrodes, and means operably associated with said discharge tube for rapidly heating the sodium vapor therewithin to a predetermined value whereby the metal vaporization period is substantially reduced.

4. The apparatus as defined in claim 3 wherein said maintaining means comprises a variable power supply which is coupled to said lamp electrodes to initiate the discharge therebetween, said variable power supply being coupled to said heating means prior to the initiation of said discharge to rapidly heat the vapor to said predetermined value whereby the breakdown period is substantially reduced.

5. The apparatus as defined in claim 4 further including control means coupled to said variable power supply to adjust the output thereof to a value whereby said vapor is heated to said predetermined value prior to the initiation of said discharge, said control means being responsive to signals representing the current flowing through said heating means and the voltage applied thereto.

6. The apparatus as defined in claim 5 wherein said voltage and current signals provide a further signal which represents the resistance value of said heating means, said resistance value being directly related to the temperature of said vapor source.

7. Apparatus for controlling the operating temperature of a low pressure metal or metal halide vapor lamp in photocopying apparatus comprising:

a low pressure metal vapor source including a discharge tube having spaced-apart electrodes and a low pressure metal vapor therein, means for applying an electrical signal to said electrodes of an amplitude sufficient to cause a breakdown of said vapor and to initiate a discharge between said electrodes, heating means operatively associated with said discharge tube for heating said vapor therewithin to a predetermined temperature; and means for applying an electrical signal to said heating means to energize said heating means and maintain said vapor at said predetermined temperature.

8. The apparatus as defined in claim 7 wherein said electrical signal applying means includes a variable power supply operatively coupled to said source electrodes to initiate the discharge therebetween, said variable power supply being operatively coupled to said heating means prior to the initiation of said discharge to rapidly heat the vapor to said predetermined temperature to substantially reduce the metal vaporization period.

9. The apparatus as defined in claim 8 further including control means operatively coupled to said variable power supply to adjust the output thereof to a value whereby said vapor is heated to said predetermined temperature prior to the initiation of said discharge, said control means being responsive to signals representing the current flowing through said heating means and the voltage applied thereto.

10. The apparatus as defined in claim 9 wherein said voltage and current signals provide a further signal which represents the resistance value of said heating means, said resistance value being directly related to the temperature of said vapor source.

11. The apparatus as defined in claim 10 wherein said low pressure vapor source comprises a sodium vapor source.

* * * * *